US010758911B2

(12) United States Patent
Grosch et al.

(10) Patent No.: US 10,758,911 B2
(45) Date of Patent: Sep. 1, 2020

(54) PROCESSING DEVICE, AND PROCESSING ELEMENT AND WALL LINING ELEMENT FOR A PROCESSING DEVICE OF THIS KIND

(71) Applicant: BHS-Sonthofen GmbH, Sonthofen (DE)

(72) Inventors: Kai Grosch, Sonthofen (DE); Manuel Huber, Petersthal (DE)

(73) Assignee: BHS-Sonthofen GmbH, Sonthofen (DE)

( * ) Notice: Subject to any disclaimer, the term of this patent is extended or adjusted under 35 U.S.C. 154(b) by 273 days.

(21) Appl. No.: 15/767,380

(22) PCT Filed: Oct. 31, 2016

(86) PCT No.: PCT/EP2016/076205
§ 371 (c)(1),
(2) Date: Apr. 11, 2018

(87) PCT Pub. No.: WO2017/076795
PCT Pub. Date: May 11, 2017

(65) Prior Publication Data

US 2018/0297034 A1 Oct. 18, 2018

(30) Foreign Application Priority Data

Nov. 2, 2015 (DE) ..... 10 2015 221 425

(51) Int. Cl.
*B02C 13/00* (2006.01)
*B02C 13/18* (2006.01)
(Continued)

(52) U.S. Cl.
CPC ..... *B02C 13/1835* (2013.01); *B02C 13/185* (2013.01); *B02C 13/282* (2013.01); *B02C 13/2804* (2013.01)

(58) Field of Classification Search
CPC ..... B02C 13/1835; B02C 13/282; B02C 13/2804; B02C 13/185
See application file for complete search history.

(56) References Cited

U.S. PATENT DOCUMENTS 982,516 A 1/1911 Marks
3,058,679 A * 10/1962 Adams ..... B02C 13/1814 241/275
(Continued)

FOREIGN PATENT DOCUMENTS

DE 26 50 906 6/1977
DE 30 13 662 10/1981
(Continued)

OTHER PUBLICATIONS

German Search Report for German application No. 10 2015 221 425.7, dated Mar. 30, 2016; 9 pages.
(Continued)

*Primary Examiner* — Faye Francis
(74) *Attorney, Agent, or Firm* — Rankin, Hill & Clark LLP

(57) ABSTRACT

A processing device for processing material to be processed includes a stationary housing with a feed opening for feeding material to be processed and a rotor which is arranged in the stationary housing so as to be rotatable about a vertically extending rotor axis. A plurality of bearing pins is fastened to a base element of the rotor adjacent to the outer circumference of the base element. A processing element is mounted on each of the bearing pins, and the radially outer ends of the processing elements form a processing gap with an inner circumferential wall of the stationary housing. The free ends of the bearing pins are connected to one another via a connecting disc.

20 Claims, 12 Drawing Sheets

(51) Int. Cl.
*B02C 13/28* (2006.01)
*B02C 13/282* (2006.01)

(56) References Cited

U.S. PATENT DOCUMENTS

| | | | | | |
|---|---|---|---|---|---|
| 3,474,974 | A | | 10/1969 | Wood | |
| 3,578,254 | A | * | 5/1971 | Wood | B02C 13/1835 241/275 |
| 3,955,767 | A | * | 5/1976 | Hise | B02C 13/1814 241/275 |
| 4,090,673 | A | * | 5/1978 | Ackers | B02C 13/1814 241/275 |
| 4,690,341 | A | * | 9/1987 | Hise | B02C 13/1842 241/275 |
| 4,787,564 | A | * | 11/1988 | Tucker | B02C 13/1814 241/275 |
| 4,896,838 | A | * | 1/1990 | Vendelin | B02C 13/1842 241/275 |
| 2,359,911 | A | | 10/1994 | Grindle | |
| 5,497,951 | A | * | 3/1996 | Watajima | B02C 13/18 241/275 |
| 5,954,282 | A | * | 9/1999 | Britzke | B02C 13/1814 241/275 |
| 6,554,215 | B1 | * | 4/2003 | Schultz | B02C 13/1835 241/275 |
| 7,416,146 | B2 | * | 8/2008 | Britzke | B02C 13/1814 241/275 |
| 7,530,512 | B2 | * | 5/2009 | Dallimore | B02C 13/1842 241/274 |
| 8,016,219 | B2 | * | 9/2011 | Condon | B02C 13/1814 241/182 |
| 8,967,516 | B2 | * | 3/2015 | Dallimore | B02C 13/28 241/300 |
| 9,914,128 | B2 | * | 3/2018 | Hackworth | B02C 13/1835 |
| 2003/0025020 | A1 | * | 2/2003 | Britzke | B02C 13/1814 241/275 |
| 2006/0011762 | A1 | * | 1/2006 | Dallimore | B02C 13/1835 241/275 |
| 2008/0135660 | A1 | | 6/2008 | Hall | |
| 2016/0288131 | A1 | * | 10/2016 | Esbelani | B02C 13/1835 |

FOREIGN PATENT DOCUMENTS

| | | |
|---|---|---|
| DE | 30 17 437 | 11/1981 |
| DE | 10 2010 036 851 | 2/2012 |
| JP | 57-63142 | 4/1982 |
| JP | 2013132631 | 7/2013 |

OTHER PUBLICATIONS

Written Opinion and International Search Report for International application No. PCT/EP2016/076205, dated Feb. 6, 2017; 10 pages (English and German).

Japanese Office Action for Japanese patent application No. 2018-521093 dated Jun. 4, 2019, 8 pages (Japanese).

* cited by examiner

PROCESSING DEVICE, AND PROCESSING ELEMENT AND WALL LINING ELEMENT FOR A PROCESSING DEVICE OF THIS KIND

The invention relates to a processing device for processing material to be processed, comprising a stationary housing having a feed opening for feeding material to be processed, and a rotor that is arranged in the stationary housing so as to be rotatable about a substantially vertical rotor axis, the outer circumference of a base element of the rotor being fastened to the base element so as to be adjacent to a plurality of bearing pins, on each of which bearing pins a processing element is mounted, and the radially outer ends of the processing elements, together with an inner circumferential wall of the stationary housing, forming a processing gap.

Processing devices of this kind are marketed by the applicant under the designation "RPM rotor impact mill" or "RPMV rotor impact mill" for example. While the RPM rotor impact mill is suitable for crushing substances that have a low or average degree of abrasiveness, in particular mineral substances, and is used in particular for producing sands for any application, for example for the concrete, asphalt and dry mortar industry, and for grinding fertiliser, the RPMV rotor impact mill is used in the recycling industry for example, since composite material can be crushed and separated thereby, it being possible for tangles of material to be separated out and for metals to be rolled into balls and purified.

The processing device according to the invention is also intended for these types of material processing.

Both the RPM rotor impact mill and the RPMV rotor impact mill have been found to be excellent in practice. Nonetheless, it is desirable to further improve said processing devices, in particular with the aim of more sophisticated material processing.

The object of the present invention is therefore that of providing a processing device of the type mentioned at the outset, by means of which an improved processing result can be achieved.

This object is achieved according to the invention by a processing device of the type mentioned at the outset, in which the free ends of the bearing pins are interconnected by means of a connecting plate.

As a result of the connecting plate provided according to the invention, the forces occurring during material processing can be better distributed over the entire rotor, i.e. the base element, the bearing pins fastened thereto and the processing elements mounted thereon. This makes it possible to operate the rotor at a higher speed, which in turn leads to an improved processing result.

In order to prevent an excessive increase in the weight of the rotor, it is proposed for the connecting plate to be formed as a ring wheel. This embodiment has been found to be entirely sufficient in tests. Specifically, the forces occurring during the material processing are introduced into the bearing pins mainly in the circumferential direction of the rotor by the processing elements, and therefore mutual support of the bearing pins in the circumferential direction of the rotor is also sufficient for achieving the desired effect.

The inner circumferential wall of the stationary housing can be protected at least in part, preferably at least at the height of the processing elements, by wall lining elements which, together with the radially outer ends of the processing elements, form the processing gap.

In order to be able to further improve the processing result, it is proposed for the wall lining elements to be immovably connected, for example screwed, to the inner circumferential wall of the stationary housing. Changes in the width of the processing gap caused by movements of the wall lining elements relative to the inner circumferential wall of the stationary housing can thus be reduced, if not entirely prevented. This also contributes to a homogenisation, and thus an improvement, of the processing result.

Just as in the RPM and RPMV rotor impact mills, it is advantageous in the processing device according to the invention, too, for at least one wall lining element to comprise a plurality of substantially vertical ribs at least over a portion of the height extension of the processing elements, preferably over the entire height extension thereof. These ribs can increase the stress on the material to be processed, and thus improve the processing result.

Moreover, as is already the case in the RPM and RPMV rotor impact mills, it is advantageous in the processing device according to the invention, too, for the processing elements to be U-shaped, the free ends of the U-shape forming the radially outer ends of the relevant processing element, and the central portion of the U-shape of the processing elements being held, from the inside in the radial direction, on the associated bearing pin only by means of the centrifugal forces occurring during operation, such that, if necessary, said elements can escape freely, radially towards the inside, from processing forces acting on said elements from the processing gap.

In order to be able to further improve the processing result, it is proposed for a wedge-shaped projection to be provided on the inside of the U-shape of the processing element, which projection engages in a wedge-shaped recess in the bearing pin that is formed so as to correspond to the wedge-shaped projection, or on an adapter element mounted on the bearing pin. The cooperation of the wedge surfaces of the wedge-shaped projection with the wedge surfaces of the wedge-shaped recess corresponding thereto makes it more difficult for the processing element to tilt about a substantially vertical axis, which tilting results in one radially outer end of the processing element approaching the inner circumferential wall of the stationary housing and the other radially outer end of said element moving further away from the inner circumferential wall, and thus a change in the width of the processing gap. This stabilisation of the mounting of the processing element also contributes to a homogenisation, and thus an improvement, of the processing result.

The opening angle of the wedge can be between approximately 120° and 140°, preferably approximately 130°.

In a development of the embodiment of the processing elements, it is proposed for two portions of the processing element that are adjacent to, preferably directly connected to, the radially outer ends of the processing element to extend so as to be substantially mutually parallel. Therefore, the spacing of the two radially outer ends does not change, even in the event of wear on the processing element.

The above-mentioned tilting of the processing element about a substantially vertical axis can furthermore be impeded by means of the inner surfaces of the substantially mutually parallel portions to be in contact with likewise substantially mutually parallel side faces of the bearing pin. The processing element can thus be guided substantially in the radial direction over a length of at least 35 mm, preferably at least 50 mm.

Impeding the tilting of the processing element about a substantially vertical axis, mentioned above, can also reduce the risk of the processing element detaching from the bearing pin thereof during operation and damaging the processing device.

Furthermore, a plurality of adapter elements can be provided, which elements differ from one another in terms of the spacing between the wedge tips of the wedge of the wedge-shaped recess facing the processing element and the wedge-shaped projection facing the bearing pin. The adapter element suitable for the application in question can in each case be selected from this set of adapter elements. Moreover, a wear-induced change in the length of the processing element can be compensated thereby. In conjunction with the substantially parallel course of the portions of the processing element adjacent to the radially outer ends of the processing element, the processing ratios in the processing gap can additionally be kept at least approximately constant, even in the event of wear of the processing element. The above-mentioned spacing can vary for example in steps of a few millimetres, for example in 4 mm steps.

It should also be mentioned, with regard to the processing elements, that the symmetry of the U-shape thereof makes it possible to ensure uniform wear of the radially outer ends of the processing elements by reversing the direction of rotation of the rotor.

It is also possible for at least one processing element to be designed so as to be symmetrical with respect to a horizontal plane. This further symmetry makes it possible to invert the processing elements in the height direction when servicing the processing device, in order to thus ensure uniform wear of the processing elements. Preferably all of the processing elements have this symmetry.

According to a first alternative development of the processing device according to the invention, a preferably conical distribution element may be arranged on the base element of the rotor, which distribution element diverts material to be processed, which material is fed in substantially vertically, in a substantially radial direction relative to the substantially vertical rotor axis.

Upon striking the rotor, the material to be processed is accelerated outwards by means of centrifugal forces, captured by the processing elements, and slung against the inner circumferential wall of the stationary housing. Crushing takes place here by means of impact and shearing. The material rebounding from the inner circumferential wall of the stationary housing is again captured by the processing elements, in the process is crushed by further striking, and slung back against the inner circumferential wall of the stationary housing. This process is carried out several times and causes intensive, repeated stress on the material to be processed. The processed material leaves the rotor through an outlet gap between the rotor and the inner circumferential wall of the stationary housing, below the processing gap.

However, according to a second alternative development of the processing device according to the invention, it is also possible for the material to be processed that is fed in substantially vertically to be fed to the upper surface of the connecting plate or of an element connected thereto.

Upon striking the upper surface of the connecting plate or of the element connected thereto, the material to be processed is uniformly distributed over said upper surface and accelerated radially outwards by means of centrifugal forces. There, said material passes through an inlet gap between the inner circumferential wall of the stationary housing and the connecting plate or the element connected thereto, and enters the processing gap between the processing elements and the inner circumferential wall of the stationary housing. When passing through the processing gap, the material to be processed is exposed to impact, tensile, compressive and shearing stresses, as a result of which bonds are broken, brittle components crushed, and ductile components deformed, in particular rolled into balls. A particular advantage that should be noted is that, in this second alternative development, the entire height of the processing gap can be used for processing the material to be processed.

In this second alternative embodiment, in order to be able to protect the inner circumferential wall from excessive wear even above the rotor, i.e. where the material to be processed strikes the inner circumferential wall, it is proposed for at least one wall lining element to comprise a first portion that is designed and intended to extend substantially above the upper edge of the processing elements during operation of the processing device, and a second portion that is designed and intended to extend beyond the rotor by a specified height during operation of the processing device. Preferably all the wall lining elements are designed in this manner.

It should furthermore be noted that wall lining elements developed in this way can also be used in the first alternative embodiment. It is therefore possible to convert the processing device according to the invention between the first and second alternative developments.

In a development of the wall lining element, it is proposed for at least one substantially vertical rib, which is provided in the first portion, to extend into the second portion, and preferably to extend over the entire height of the second portion. The at least one rib extending into the second portion functions as an obstacle that is intended to brake material to be processed that has also gained a speed component in the circumferential direction during the radially outward acceleration, in order to make it easier for said material to enter the processing gap.

It is furthermore proposed for at least one substantially vertical rib that is provided in the first portion to end at a position which, during operation of the processing device, is at least at the height of the upper edge of the processing elements but no higher than the height of the upper surface of the rotor. As a result of this development, the inlet gap adjacent to the upper surface of the rotor has a wider portion, which makes it easier for material to be processed to enter the processing gap.

In addition, it is possible for the upper edge of the at least one rib to be formed having a termination surface that extends obliquely away from the wall lining element and in the direction from the second portion to the first portion. Said termination surface functions as an admission slope for the material to be processed, which slope facilitates the transfer of said material from the wider portion into the narrower portion.

The wall lining element may comprise four substantially vertical ribs for example, the two outer ribs of which extend only over the height of the first portion, while the two inner ribs extend into the second portion and preferably extend over the entire height of the wall lining element. Furthermore, an opening for an upper fastening screw may be provided in the second portion, between the two inner ribs, and an opening for a lower fastening screw may be provided in the first portion, between each of the two rib pairs formed by an outer rib and an inner rib, in order to fasten the wall lining element to the inner circumferential wall of the stationary housing. Furthermore, a widened depression may be provided adjacently to the openings, which depression receives the head of the relevant fastening screw. The fastening screws can thus be protected, by one rib pair in each case, from damage by material to be processed.

In order to be able to achieve continuous protection of the inner circumferential wall of the stationary housing by means of the wall lining elements, it is further proposed for the lateral edges of the wall lining elements to comprise projections that mutually overlap in pairs. For example, both lateral edges of at least one wall lining element may comprise a shoulder that extends substantially over the entire height of the wall lining element, the thickness of which shoulder is substantially equal to half the thickness of a base plate of the wall lining element, one shoulder being arranged adjacently to the surface of the wall lining element that rests on the inner circumferential wall of the stationary housing when the wall lining element is assembled, while the other shoulder is arranged so as to be remote from said surface.

In a development of the invention, it is proposed for at least one wear-protection element to be arranged on the upper surface of the base element of the rotor and/or on the lower surface of the connecting plate and/or on the upper surface of the connecting plate and/or on the outer circumferential surface of the connecting plate and/or on the inner circumferential surface of the connecting plate and/or on the radially outer surface of the bearing pins.

According to further aspects, the invention relates to a processing element and a wall lining element for the processing device according to the invention. Regarding the structure and the function of said processing element and wall lining element, reference is made to the above discussion of the processing device according to the invention.

The invention will be explained in greater detail in the following, with reference to the accompanying drawings and on the basis of two embodiments. In the drawings.

Figure 1:
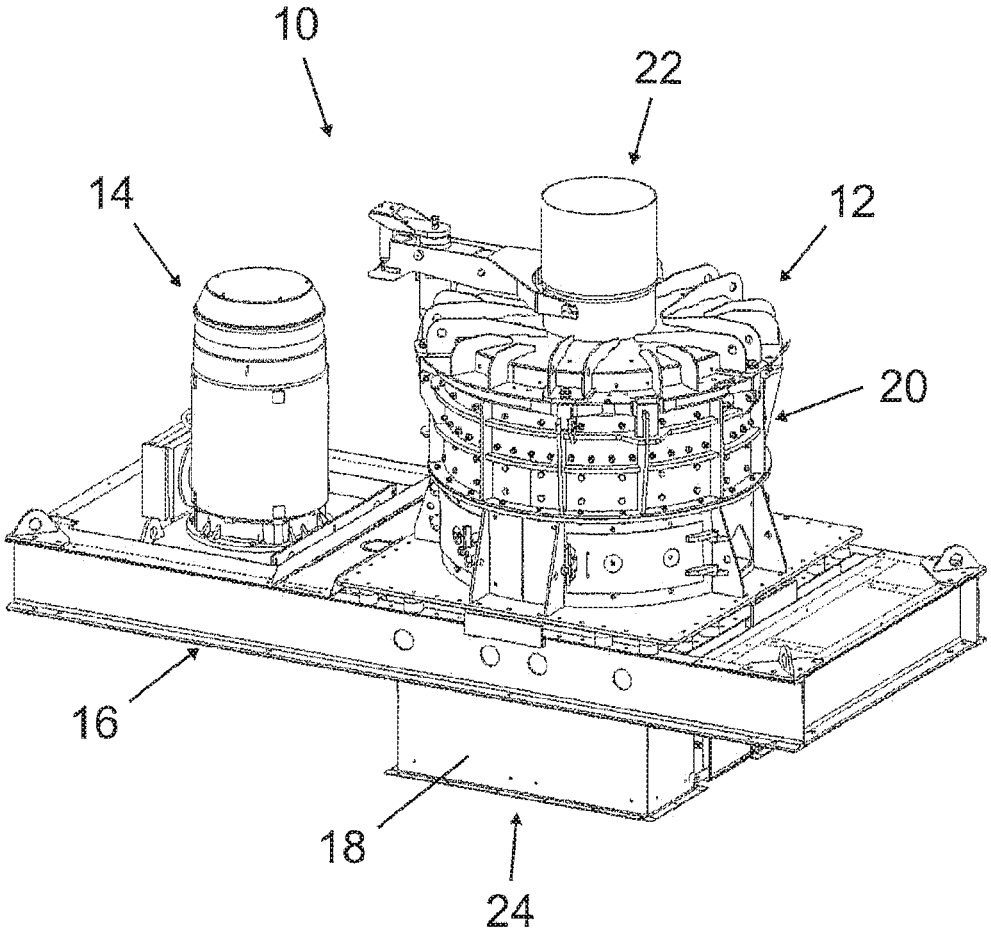
FIG. 1 is a perspective view of an embodiment of the processing device according to the invention.

FIG. 1 shows the processing device 10 according to the invention, which device comprises a tower unit 12 and a drive unit 14 that are arranged on a vibration isolator 16. The vibration isolator 16 is in turn supported by a base 18 that can be connected to the foundations of a factory building or to further components of a processing facility for example.

The tower unit 12 comprises a stationary housing 20 which, in the embodiment shown in FIG. 1, is substantially cylindrical and comprises a feed opening 22 at the upper end thereof in order to be able to introduce material to be processed into the processing device 10. The material processed by the processing device 10 according to the invention can subsequently leave the processing device 10 through the base 18 for example, which base thus also functions as a material discharge point 24 in the embodiment of the processing device 10 according to the invention shown in FIG. 1.

Figure 2:
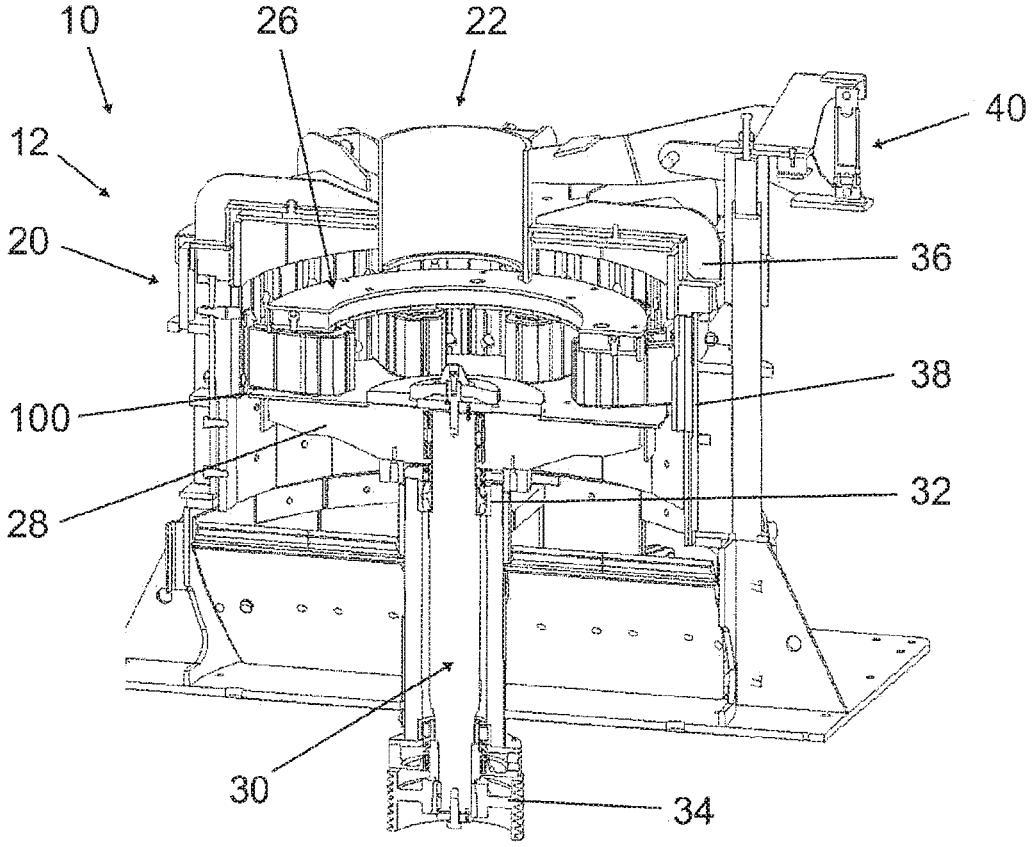
FIG. 2 is a perspective cross-sectional view of a tower unit of the processing device from FIG. 1.

FIG. 2 is a cross-sectional view from the side of the tower unit 12 from FIG. 1, the cutting plane extending through a central axis formed by the cylindrical shape of the housing 20. In this case, it can be seen in FIG. 2 that the stationary housing 20 defines an inner cavity into which the feed opening 22 leads. A rotor 26 is received in the cavity of the stationary housing 20, the underside of which rotor is connected, using reinforcement elements 28, to an upper end of a drive shaft 30 that is rotatably mounted by means of a bearing 32, an oil grease bearing in the embodiment shown in FIG. 2. A sheave 34 is provided at a lower end of the drive shaft 30, which sheave is connected to the drive shaft 30 for conjoint rotation and is connected to a corresponding output shaft of the drive unit 14 by means of a belt, for example a V-belt. In the embodiment shown here, the unit that drives the output shaft of the drive unit 14 is formed as an electric motor.

The stationary housing 20 of the tower unit 12 is divided into a cover unit 36 and a pot unit 38, the cover unit 36 being able to be raised off the pot unit 38 by means of a pivot device 40 and pivoted away from the pot unit 38 and/or pivoted towards the pot unit 38 and lowered onto said unit.

Figure 3:
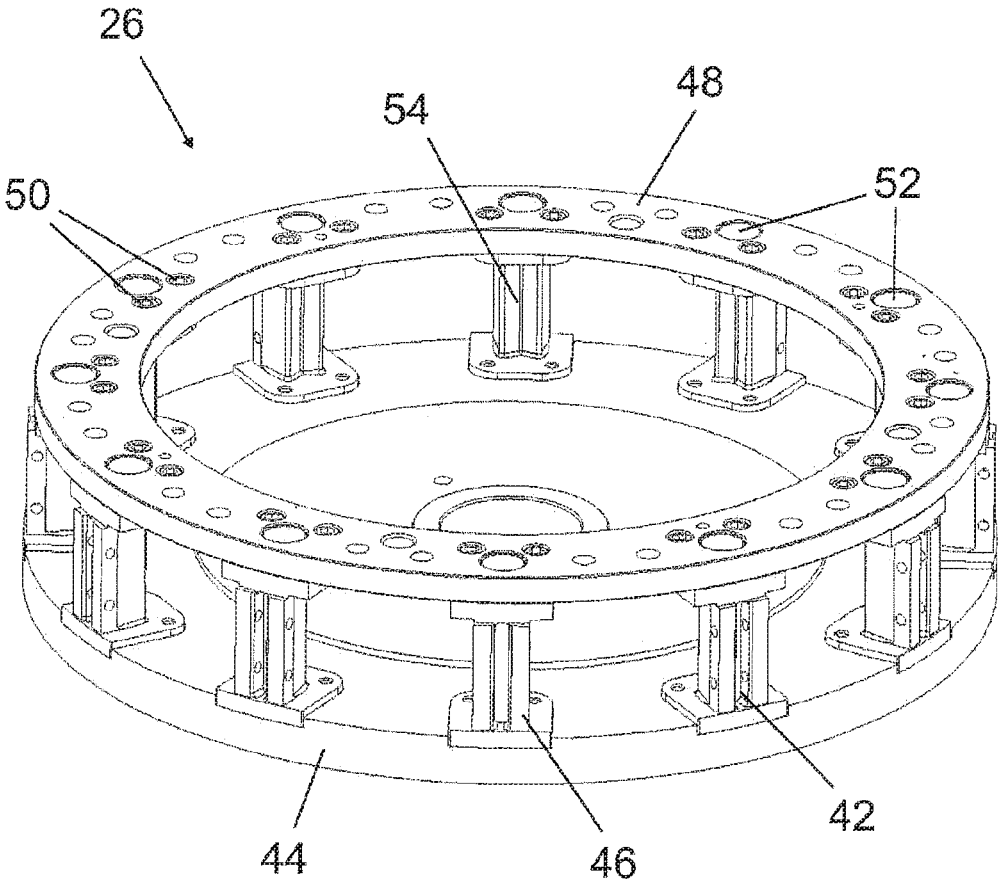
FIG. 3 is a perspective view of a rotor of the processing device according to the invention, without processing and wear-protection elements attached thereto.
Figure 4:
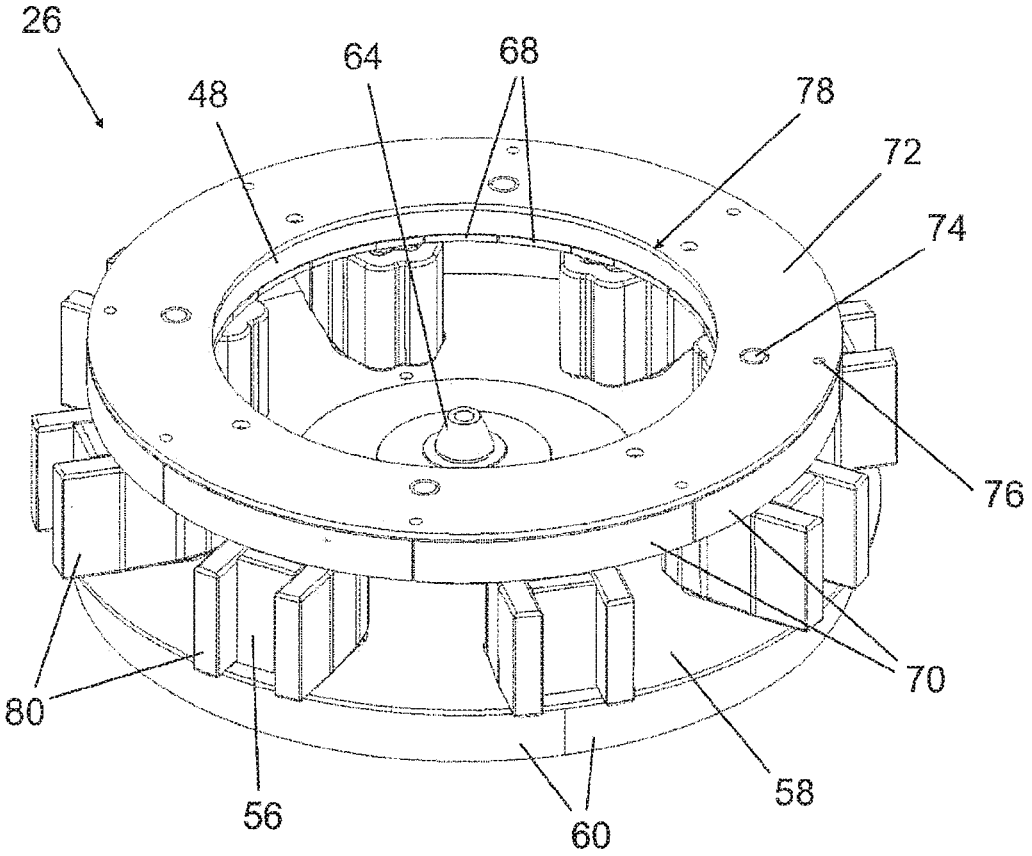
FIG. 4 is a perspective view of the rotor from FIG. 3, comprising attached processing and wear-protection elements.
Figure 5:
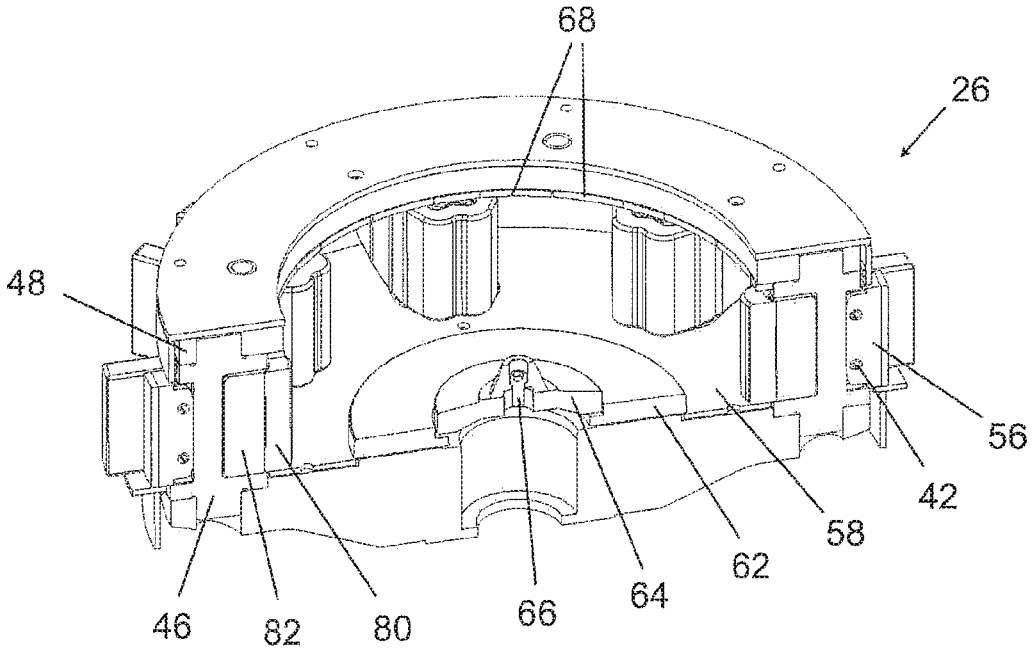
FIG. 5 is a perspective cross-sectional view of the rotor from FIG. 4.

FIGS. 3 to 5 show the rotor 26 without the rest of the components of the processing device 10. As can be seen in FIG. 3, the rotor 26 comprises a base element 44 on which bearing pins 46 are arranged, which bearing pins extend upwards, substantially vertically, from a substantially horizontal upper surface of the base element 44. The bearing pins 46 are interconnected, at the upper surface thereof, by an annular connecting plate 48. On account of the bearing pins 46 being connected both by the connecting plate 48 and by the base element 44, forces acting on an individual bearing pin 46 are also distributed over the rest of the bearing pins 46.

In this case, the bearing pins 46 are connected both to the base element 44 and to the connecting plate 48 by means of fastening screws 50 (only two of which have been provided with reference signs in FIG. 3). In order to prevent the fastening screws 50 from being subjected to forces acting transversely to a screw longitudinal extension direction of the fastening screws 50 in addition to the retaining force applied by said screws between the connecting plate 48 and the bearing pin 46 and/or between the bearing pin 46 and the base element 44, the bearing pins 46 are furthermore connected to the base element 44 and to the connecting plate 48 by means of fastening bolts 52, the fits of the fastening bolts 52 in the corresponding recesses compared with the fits of the fastening screws 50 in the corresponding recesses thereof always being selected such that forces, apart from the above-mentioned retaining forces, acting on one bearing pin 46 are distributed to the connecting plate 48 and/or to the base element 44, and thus to the rest of the bearing pins 46, via the bolts 52 and not via the fastening screws 50.

On the radially inner side thereof relative to the base element 44, the bearing pins 46 comprise a V-shaped depression 54. On the side thereof opposite the V-shaped depression 54, the bearing pins 46 comprise receptacles 42 for bearing-pin wear-protection elements 56, as shown in FIGS. 3 to 5. It can furthermore be seen from FIG. 4 that the base element 44 is provided with a wear-protection plate 58 on the upper surface thereof and with first wear-protection elements 60 on the outer circumference thereof. The substantially discoid base element 44 is connected, on the upper surface thereof and in the region of the centre thereof, to an annular wear-protection plate 62, as can be seen in FIG. 5 for example, the central opening of which wear-protection plate in turn receives a wear-protection element comprising a conical mandrel 64. In the embodiment shown, the conical mandrel of the corresponding wear-protection element 64 comprises a central through-opening, via which at least the wear-protection element comprising the conical mandrel 64 can be connected to the drive shaft 30 by means of a fastening screw 66. As a result, the rotor 46 can be fastened to the drive shaft 30 at least in a direction that is axial thereto.

It can furthermore be seen in FIGS. 4 and 5 that the connecting plate 48 comprises on the lower surface thereof a plurality of second wear-protection elements 68, connected to said plate, and comprises on the outer circumference thereof a plurality of third wear-protection elements 70, connected to said plate. The upper surface of the connecting plate 48 comprises an upper wear-protection plate 72, a first embodiment of said upper wear-protection plate 72 being shown in FIGS. 2 to 5. Similarly to the connection between the connecting plate 48 and/or the base element 44 and the bearing pins 46, at least the upper wear-protection plate 72, and optionally also the remaining wear-protection elements, is/are connected to the connecting plate 48 by means of bolts 74 and by means of fastening screws 76, the bolts 74 being designed to absorb the horizontal component of the forces acting on the upper wear-protection plate 72. The embodiment of the upper wear-protection plate 72 shown in FIGS. 2 to 5 comprises a central through-opening 78 having substantially the same diameter as the central opening of the annular connecting plate 48.

Figure 6:
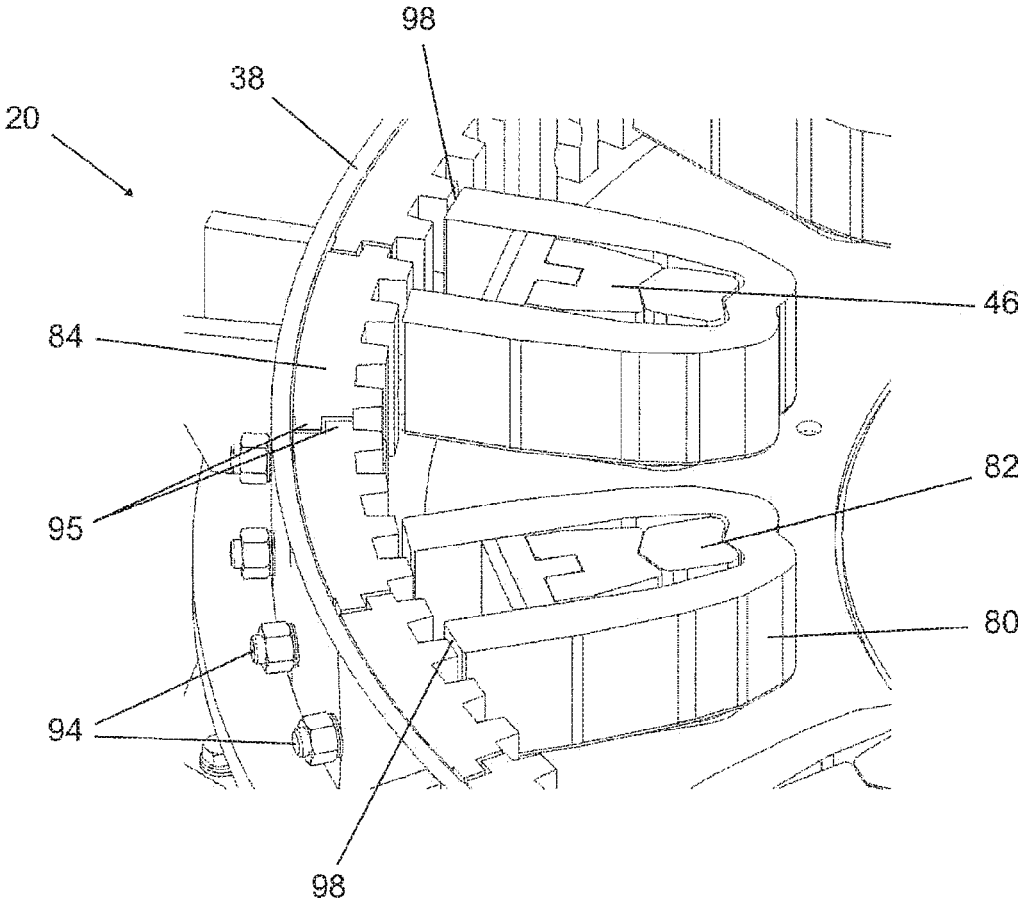
FIG. 6 is a perspective cross-sectional view of a detail of the rotor from FIG. 4, the rotor being shown in a horizontal cross section.
Figure 7:
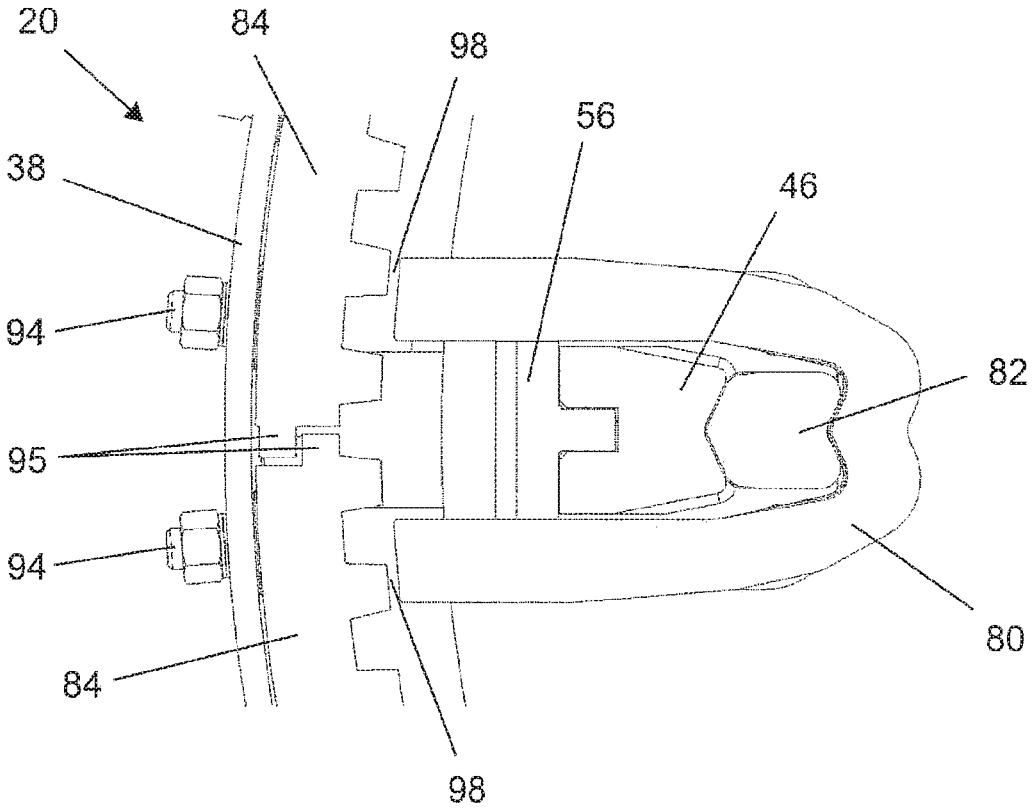
FIG. 7 is a plan view of a portion of the detail of the rotor from FIG. 6.

Furthermore, processing elements 80 can be seen in FIGS. 4 and 5 which, as shown in FIGS. 6 and 7, are substantially U-shaped. A central portion of the U-shape that connects the two free legs of the U-shape is spaced apart from the associated bearing pin 46, optionally using adapter elements 82, in a direction radial to the base element 44. On the radially inner face thereof relative to the base element 44, the adapter elements 82 comprise a V-shaped recess which corresponds to a V-shaped projection on a side of the central portion of the U-shape of the processing element 80 facing the free legs of the U-shape, such that, when assembled, the V-shaped projection of one processing element 80 engages in the V-shaped recess of an adapter element 82 associated therewith. The adapter elements 82 comprise V-shaped projections on the radially outer side thereof, which projections can engage in the V-shaped depressions 54 on the bearing pins 46.

It can furthermore be seen in FIG. 7 that the inner surfaces of the free legs of the U-shape of the processing elements 80 extend so as to be substantially mutually parallel, in the embodiment shown here said legs being slidably mounted on two lateral surfaces of an associated bearing-pin wear-protection element 56.

The processing elements 80 are designed to be able to be produced by means of a casting process.

Figure 8:
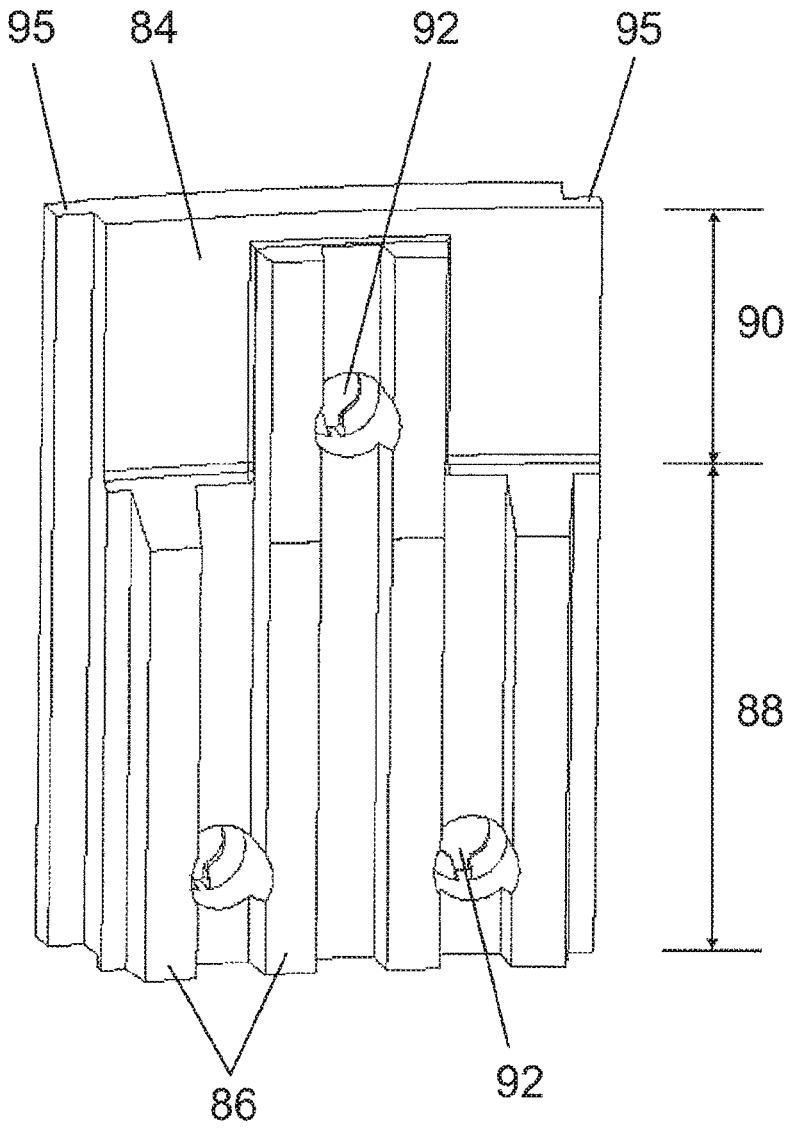
FIG. 8 is a perspective view of an embodiment of the wall lining element according to the invention.

FIGS. 6 and 7 show that an inner circumferential wall of the stationary housing 20 of the tower unit 12, in particular of the pot unit 38, is provided with wall lining elements 84. The wall lining elements 84 are shown in greater detail in FIGS. 8 and 9. In this case, the wall lining elements 84 are curved such that they can be attached in the circumferential direction along the inner circumferential surface of the stationary housing 20, so as to adjoin one another. In the embodiment shown here, one wall lining element 84 in each case comprises four parallel ribs 86 on the radially inner surface thereof, the two outer ribs 86 extending only over a first region 88, while the two inner ribs 86 extend both over the first region 88 and in part over a second region 90. In this case, the end faces of the two outer ribs 86 facing the second region 90 are inclined so as to extend radially inwards, towards the first region 88. In each case, a recess 92 for a fastening screw 94 is provided in the first region 88, between the outer rib 86 and the central rib 86 adjacent thereto (as shown in FIGS. 6 and 7). A further recess 92 for a fastening screw 94 is provided in the central region 90, between the two central ribs 86. The end faces of the wall lining elements 84 extending perpendicularly to the circumferential direction are provided with projections 95 such that, when the wall lining elements 84 are assembled, two adjacent wall lining elements 84 mutually overlap in each case (see FIGS. 6 to 9).

Figure 9:
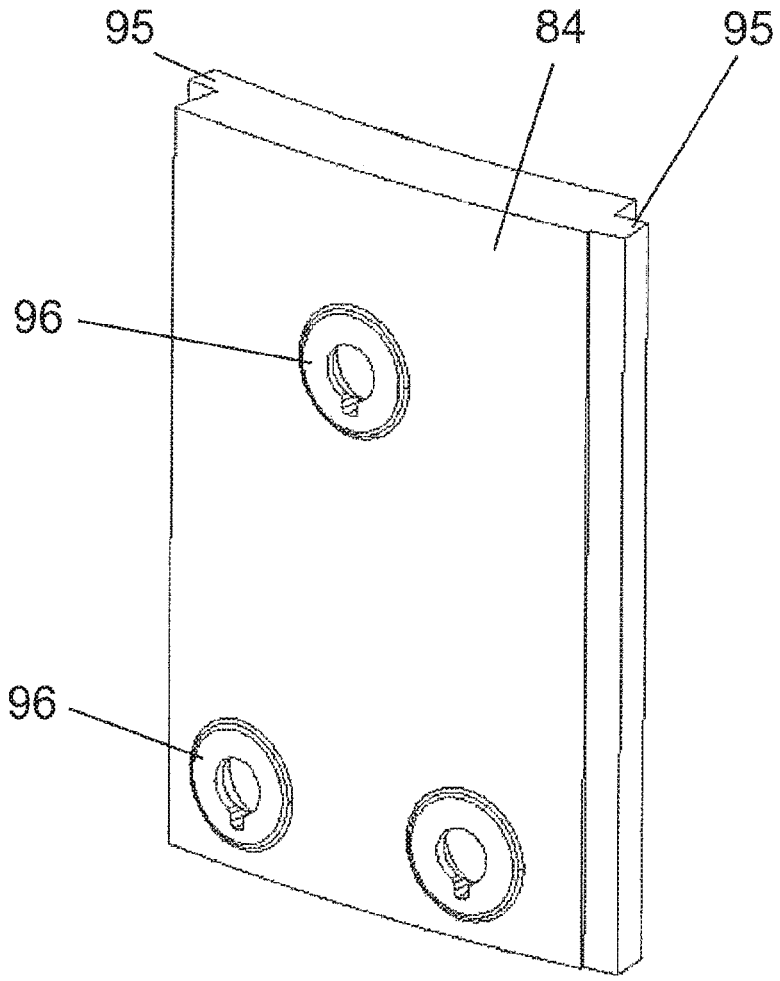
FIG. 9 is a perspective rear view of the wall lining element from FIG. 8.

FIG. 9 is a rear view of the wall lining element 84, in which three recesses 92 for the fastening screws 94 can be seen. Each recess 92 is surrounded by a projection 96. In this case, the projections 96 function as spacers from the inner circumferential surface of the stationary housing 20. A defined contact region is thus formed between the inner circumferential surface of the stationary housing 20 and the projections 96 of the wall lining elements 84. If the inner circumferential surface of the stationary housing 20 is provided with recesses corresponding to the projections 96, the projections 96 of the wall lining elements 84 can also be used for positioning the wall lining elements 84 on the inner circumferential surface of the stationary housing 20.

In the following, the mode of operation of the processing device 10 will be described.

Material to be processed that is introduced into the stationary housing 20 of the tower unit 12 via the feed opening 22 falls onto the base element 44 and/or onto the wear-protection elements and wear-protection plates fastened thereto. Due to the rotation of the rotor 26, which rotor is driven by the drive unit 14, a V-belt (not shown) and the drive shaft 30, the material to be processed that strikes the rotor is accelerated radially outwards such that it impacts against either a wall lining element 84 or a processing element 80 and can be crushed there. Material rebounding from the wall lining elements 84 is captured by the outer surfaces of the free legs of the U-shape of the processing element 80 and crushed further. Material that is present in the region of the wall lining elements 84 can be captured by the tips of the free ends of the U-shape of the processing elements 80, the spacing of which from the wall lining elements 84 defines a processing gap 98 (see FIGS. 6 and 7) in which the material to be processed is furthermore subjected to shearing stress and can thus be crushed further. Sufficiently crushed material subsequently falls through an outlet gap 100 between the wall lining elements 84 and the wear-protection elements attached to the base element 44, in particular the lower wear-protection plate 58, into a region below the base element 44, from where the processed material can be removed from the processing device 10 via the material discharge point 24.

All the elements used for wear protection can be replaced if necessary. In particular, in the event of wear of the tips of the U-shape of the processing elements 80, and an associated widening of the processing gap 98, the processing gap 98 can be adjusted by radially displacing the processing elements 80. In order to achieve a radial displacement of the processing elements 80, the adapter elements 82 can be replaced by adapter elements 82' of an almost identical construction, of which only the spacing between the V-shaped recess and the V-shaped projection differs from the adapter elements 82. Selecting an adapter element having a suitable spacing between the V-shaped recess and the V-shaped projection makes it possible for the relevant processing element 80 to be radially positioned such that a desired processing gap 98 can be maintained.

Figure 10:
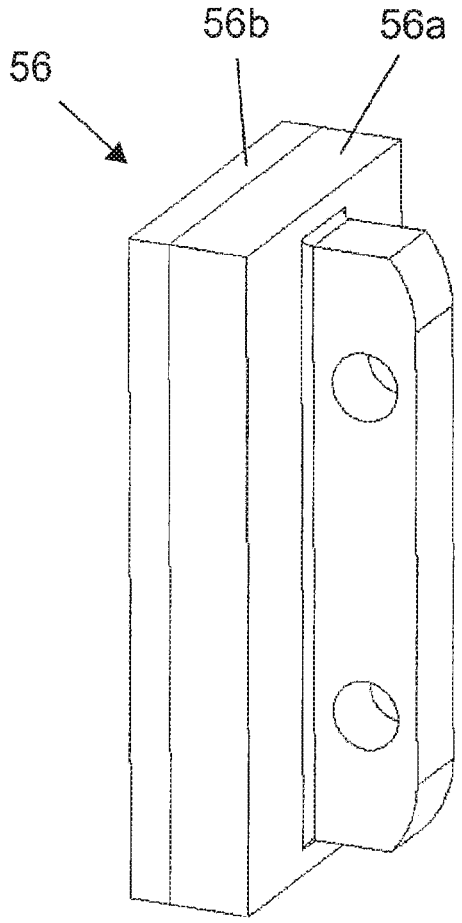
FIG. 10 is a perspective view of an embodiment of a bearing-pin wear-protection element.
Figure 11:
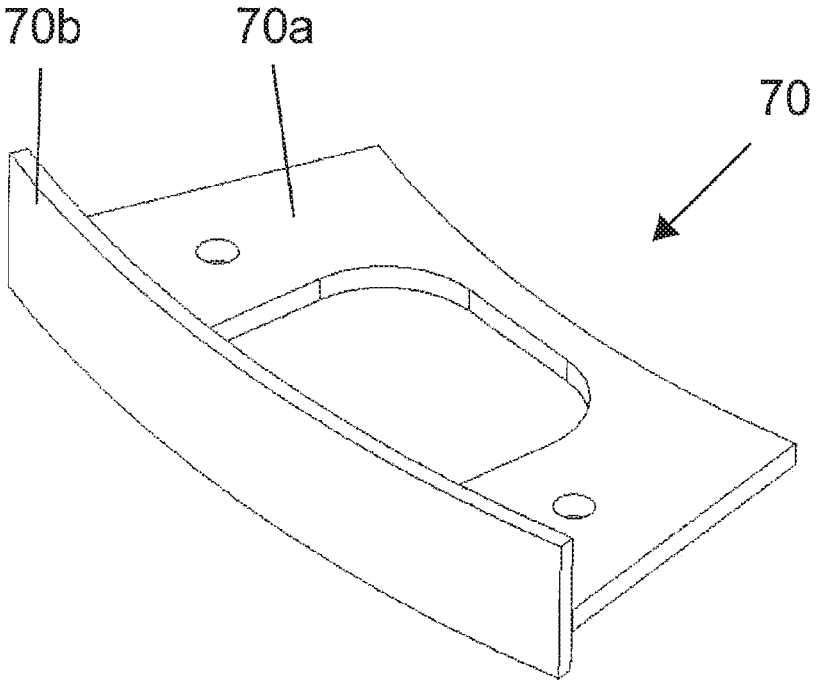
FIG. 11 shows an embodiment of a wear-protection element of the outer circumferential surface of the connecting plate.

FIGS. 10 and 11 show two wear-protection elements by way of example, FIG. 10 showing a bearing-pin wear-protection element 56 and FIG. 11 showing a third wear-protection element 70 that is used to protect the outer circumferential surface of the connecting plate 48. The wear-protection elements 56 and 70 each comprise a support 56*a* and 70*a*, respectively, which is produced from metal, for example, and to which a hard-weld coating 56*b* and 70*b*, respectively, is applied, which coating functions as an impact layer for impacting material.

Figure 12:
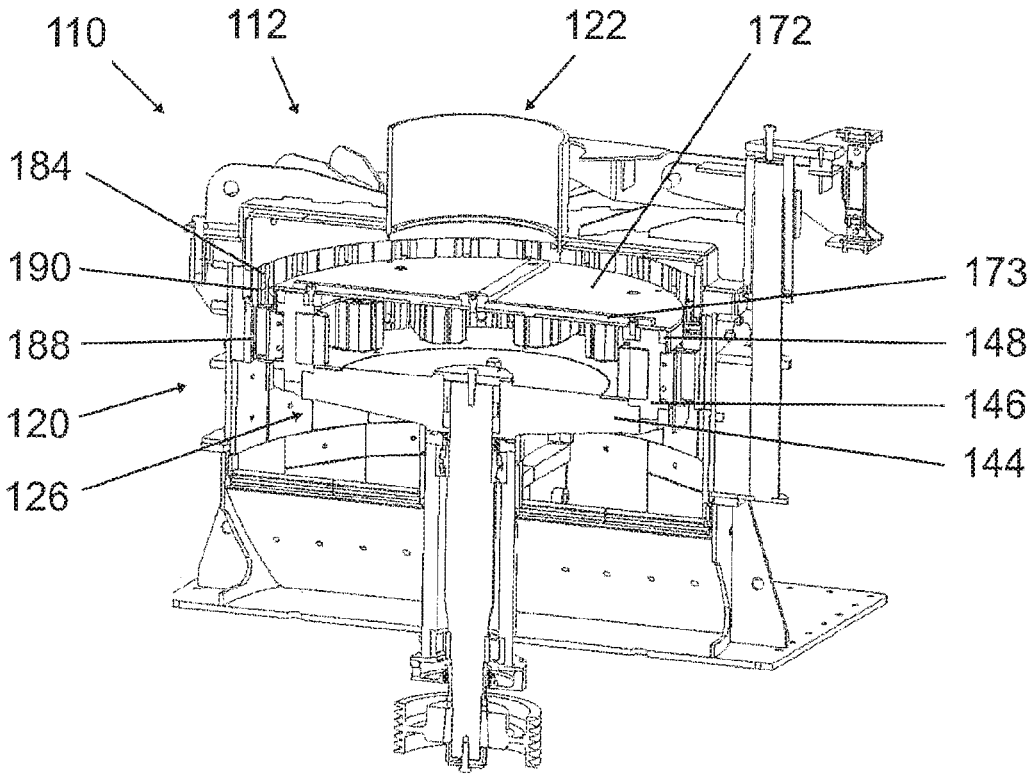
FIG. 12 is a perspective cross-sectional view similar to FIG. 2 of the tower unit of a second embodiment comprising an upper wear-protection plate.

FIG. 12 shows a second embodiment of a processing device according to the invention, or of the tower unit of said device, comprising a rotor, said device substantially corresponding to the processing device 10 according to FIGS. 1 to 11 and differing from the processing device 10 described above mainly in the embodiment of the upper wear-protection plate. Therefore, in FIG. 12, similar parts are provided with the same reference signs as in FIGS. 1 to 11 but increased by 100. The processing device 110 according to FIG. 12 will be described in the following only insofar as it differs from the embodiment according to FIGS. 1 to 11, reference hereby otherwise being explicitly made to the description of the embodiment according to FIGS. 1 to 11.

The tower unit 112 shown in FIG. 12 comprises a stationary housing 120 in which a rotor 126 is received, said element being analogous to the embodiment described above. An annular connecting plate 148 that connects a plurality of bearing pins 146 is arranged on said plurality of bearing pins, on which plate an upper wear-protection plate 172 is in turn arranged.

In comparison with the annular upper wear-protection plate 72 of the processing device 10, the upper wear-protection plate 172 of the processing device 110 is substantially discoid. This means that material to be processed that is introduced into the stationary housing 120 of the tower unit 112 through a feed opening 122 does not fall directly onto a base element 144 or onto wear-protection elements attached thereto, but instead first falls onto the upper wear-protection plate 172. From there, the material to be processed is accelerated radially outwards due to a rotation of the rotor 126, similarly to the material to be processed described above which strikes the base element 44 of the processing device 10 and is accelerated. On an outer circumferential wall of the stationary housing 120, the material to be processed strikes wall lining elements 184 which are identical to the wall lining elements 84 described above. The wall lining elements 184 are in particular arranged relative to the upper wear-protection plate 172 in such a way that a first region 188 (see reference sign 88 in FIG. 8) of the wall lining elements 184 is arranged below the upper surface of the upper wear-protection plate 172, such that material to be processed impacts the wall lining elements 184 in a second region 190 (see reference sign 90 in FIG. 8) of the wall lining elements 184, and ideally undergoes a first material crushing process there. The material to be processed can then fall from the second region 190 of the wall lining elements 184 into the first region 188 of the wall lining elements 184, and this is promoted by the above-described different embodiment of the second region 190 compared with the first region 188 of the wall lining elements 184, in order to be correspondingly processed in said first region in the manner described above.

It can further be seen in FIG. 12 that a dog device 173 is arranged on the upper wear-protection plate 172, which dog device is cross-shaped in the embodiment shown here. The dog device 173 is connected to the upper wear-protection plate 172 by means of projections and/or fastening screws and associated recesses. In this case, the dog device 173 prevents the upper wear-protection plate 172 from moving through, below the material to be processed, without providing said material with a sufficient radial acceleration component.

Since material to be processed that is introduced into the stationary housing 120 cannot fall centrally on the base element 144, there is no need to provide the radially innermost wear-protection element on the base element 144 with a conical mandrel, such as the wear-protection element comprising the conical mandrel 64 in the processing device 10, in order to distribute the material to be processed, striking said element, radially outwards from the centre.

It should also be added that the connecting plate 148 which, in the embodiment shown in FIG. 12 is identical to the connecting plate 48, can also be discoid, for example, when using a discoid upper wear-protection plate 172.

The invention claimed is:

1. Processing device for processing material to be processed, comprising a stationary housing having a feed opening for feeding material to be processed, and a rotor that is arranged in the stationary housing so as to be rotatable about a vertical rotor axis, a plurality of bearing pins being fastened to a base element so as to be adjacent to an outer circumference of the base element of the rotor, on each of which bearing pins a processing element is mounted, and radially outer ends of the processing elements, together with an inner circumferential wall of the stationary housing, forming a processing gap, wherein free ends of the bearing pins are interconnected by a connecting plate, wherein the inner circumferential wall of the stationary housing is protected at least in part by wall lining elements which, together with the radially outer ends of the processing elements, form the processing gap, and wherein at least one of the wall lining elements includes a first portion configured to extend over a height extension of the processing elements during operation of the processing device, and a second portion configured to extend beyond a height of the rotor during operation of the processing device.

2. Processing device according to claim 1, wherein the connecting plate is formed as a ring wheel.

3. Processing device according to claim 1, wherein the wall lining elements are immovably connected to the inner circumferential wall of the stationary housing.

4. Processing device according to claim 1, wherein the at least one wall lining element comprises a plurality of vertical ribs at least over a portion of the height extension of the processing elements.

5. Processing device according to claim 1, wherein the processing elements are U-shaped, free ends of the U-shape forming the radially outer ends of the processing elements, and an inside of a central portion of the U-shape of each of the processing elements being held, in the radial direction, on the corresponding bearing pin only by centrifugal forces occurring during operation.

6. Processing device according to claim 5, wherein a wedge-shaped projection is provided on the inside of the U-shape of each processing element, which projection engages in a wedge-shaped recess formed on each bearing pin.

7. Processing device according to claim 6, wherein an adapter elements is provided between each of the wedge-shaped recesses of the bearing pins and each of the wedge-shaped projections of the processing elements.

8. Processing device according to claim 1, wherein two portions of the processing element that are adjacent to the radially outer ends of the processing element extend so as to be mutually parallel.

9. Processing device according to claim 8, wherein inner surfaces of the mutually parallel portions are in contact with mutually parallel side faces of the bearing pin.

10. Processing device according to claim 1, wherein at least one of the processing elements is designed so as to be symmetrical with respect to a horizontal plane.

11. Processing device according to claim 1, wherein a conical distribution element is arranged on the base element of the rotor, which distribution element diverts material to be processed, which material is fed in vertically, in a radial direction relative to the vertical rotor axis.

12. Processing device according to claim 1, wherein the material to be processed that is fed in vertically is fed to the upper surface of the connecting plate or of an element connected thereto.

13. Processing device according to claim 1, wherein at least one vertical rib that is provided in the first portion extends into the second portion.

14. Processing device according to claim 1, wherein at least one vertical rib that is provided in the first portion ends at a position which, during operation of the processing device, is at least at a height of an upper edge of the processing elements but no higher than a height of an upper surface of the rotor.

15. Processing device according to claim 14, wherein the upper edge of the at least one rib is formed having a termination surface that extends obliquely away from the wall lining element and in the direction from the second portion to the first portion.

16. Processing device according to claim 1, wherein lateral edges of the wall lining elements comprise projections that mutually overlap in pairs.

17. Processing device according to claim 1, wherein at least one wear-protection element is arranged on an upper surface of the base element of the rotor.

18. Processing device according to claim 1, wherein at least one wear-protection element is arranged on a lower surface of the connecting plate and/or on an upper surface of the connecting plate.

19. Processing device according to claim 1, wherein at least one wear-protection element is arranged on an outer circumferential surface of the connecting plate and/or on an inner circumferential surface of the connecting plate.

20. Processing device according to claim 1, wherein at least one wear-protection element is arranged on a radially outer surface of the bearing pins.

* * * * *